US005122199A

United States Patent [19]

Schroth

[11] Patent Number: 5,122,199

[45] Date of Patent: Jun. 16, 1992

[54] COPPER BRAZED TORQUE CONVERTER PUMP HOUSING MADE FROM FORMABLE HIGH STRENGTH MICROALLOYED STEEL

[75] Inventor: James G. Schroth, Troy, Mich.

[73] Assignee: General Motors Corporation, Detroit, Mich.

[21] Appl. No.: 729,094

[22] Filed: Jul. 12, 1991

[51] Int. Cl.[5] ..... C21D 8/00

[52] U.S. Cl. ..... 148/528; 148/624; 148/622

[58] Field of Search ..... 148/12.3, 142, 328, 148/12 F, 12.4; 420/128, 127

[56] References Cited

U.S. PATENT DOCUMENTS

| | | | |
|---|---|---|---|
| 4,594,113 | 6/1986 | Elsner et al. | 148/12.3 |
| 4,784,922 | 11/1988 | Yoshimura | 148/11.5 Q |
| 4,917,738 | 4/1990 | Takano et al. | 148/325 |

OTHER PUBLICATIONS

Schwartz, Mel. M., "Brazing" published by ASM International, Metals Park, Ohio 44073 (1987).

Pickering, F. B., "High-Strength, Low-Alloy Steels-A Decade of Progress", and Gladman, T. et al., "Structure-Property Relationships in High-Strength Microalloyed Steels"; both published in the Proceedings of an International Symposium on High-Strength, Low-Alloy Steels, Microalloying 75, 39th Floor, 270 Park Avenue, New York, NY 10017 (1975).

*Primary Examiner*—R. Dean
*Assistant Examiner*—Sikyin Ip
*Attorney, Agent, or Firm*—George A. Grove; Domenica N. S. Hartman

[57] ABSTRACT

A method is provided for thermally treating a high strength, microalloyed steel so as to first induce sufficient ductility (and corresponding low strength) in the microalloyed steel to readily enable the room temperature forming and/or machining of the steel. This is accomplished by appropriately heating to a solutionizing temperature and then cooling from this temperature at an extraordinarily slow rate so as to induce coarse precipitation of any strengthening particles and to thereby minimize the strengthening contributions associated with precipitates and ferrite grain size. The formed low strength components are then thermally treated again (such as during a copper brazing cycle) so as to induce high strength and relatively lower ductility in the microalloyed steel.

10 Claims, 3 Drawing Sheets

COPPER BRAZED TORQUE CONVERTER PUMP HOUSING MADE FROM FORMABLE HIGH STRENGTH MICROALLOYED STEEL

The present invention generally relates to the thermal treatment of a high strength, microalloyed steel. More specifically, this invention relates to such a microalloyed steel having an addition of vanadium, wherein the thermal treatment includes first annealing the steel so as to result in relatively low strength, high ductility and good formabilty, and then heat treating the steel concurrently during a copper brazing step so as to produce a high strength, copper brazed component which may be suitable for use within an automotive automatic transmission system, particularly the torque converter pump housing.

BACKGROUND OF THE INVENTION

Copper brazing is an established method for joining conventional carbon steels. The copper braze is metallurgically compatible with the carbon steels and has a melting temperature that is lower than the carbon steels, so that upon heating to the melting temperature of the braze alloy, the copper braze flows into the desired joint region by capillary action and solidifies upon cooling so as to produce a leak-proof, high integrity bond between the components.

However, when using conventional low carbon steels such as AISI 1010, there is a shortcoming associated with the use of copper brazing. (AISI is the designation for the American Iron and Steel Institute.) The relatively high temperatures associated with the copper brazing process, about 1100° C. to about 1120° C., produce a coarse, strain-free grain structure of low strength in the final brazed, low carbon steel component. The copper brazed joint is generally characterized by a yield strength of only about 10,000 pounds per square inch (10,000 psi or 10 ksi). Accordingly, copper brazed assemblies are rarely used in demanding applications requiring high strength.

An exception to this generalization is the use of a copper brazed pump assembly within an automotive automatic transmission system. A copper brazed torque converter pump assembly is commonly employed in high performance applications wherein the pump is cycled at high revolutions per minute (RPM) and/or in diesel truck transmission systems which require high torque outputs. Copper brazing the blades to the pump housing within the torque converter pump, produces reinforcement and increases the rigidity and strength of the pump assembly, as compared to the practice of mechanically staking the blades in place without the subsequent copper brazing operation. Blades staked at a single position do not contribute to the rigidity of the pump assembly.

Unfortunately, the actual strength of the material used to form the torque converter pump housing, i.e., the AISI 1010 steel, is greatly reduced by the high temperature brazing cycle The strength of the pump housing is an important characteristic since increased strength allows the pump to be operated at higher RPM levels without excessive plastic deformation of the pump housing. Accordingly, high strength retention following the copper brazing process is a critical requirement, particularly when considering the intended high performance requirements for future torque converter pump assemblies which will include operating at these much higher RPM levels.

To achieve higher strengths for the pump housing, various other steels that are alloyed with elements which contribute to strength following brazing, have been substituted for the low carbon steels generally employed In particular, commercially available microalloyed high-strength low-alloy (HSLA) steels, such as compositions typical of grades AISI 050XF, or higher strength grades such as AISI 080XF, have exhibited higher strengths after thermal exposure to a simulated copper brazing cycle, as compared to the AISI 1010 steel. However, the initial high strengths of these HSLA steels are problematic in that the materials are difficult to form prior to the brazing cycle, particularly when using the tooling developed for the conventional low strength carbon steels.

Therefore what is needed is a material for use as a torque converter pump housing that is characterized by sufficient ductility so as to be readily formed and machined prior to the high temperature copper brazing operations, but that is also characterized by relatively high strength after such a brazing operation.

SUMMARY OF THE INVENTION

It is an object of this invention to provide a method for thermally treating a high strength, microalloyed steel so that it is first characterized by sufficient ductility and corresponding low strength to readily enable the room temperature forming of the material to the required shape on tooling designed for low carbon steel, yet after an additional high temperature operation the formed component of such a material is subsequently characterized by significantly higher strength.

It is a further object of this invention that such a high strength, microalloyed steel treated by the method of this invention be suitable for use within an automotive torque converter assembly, particularly the copper brazed torque converter pump housing.

In accordance with a preferred embodiment of this invention, these and other objects and advantages are accomplished as follows.

According to the present invention, there is provided a method for thermally treating a high strength, microalloyed steel so as to first induce sufficient ductility (and corresponding low strength) in the microalloyed steel to readily enable the room temperature forming and/or machining of the steel. This is accomplished prior to a subsequent thermal treatment (such as a copper brazing cycle) that induces high strength and relatively lower ductility in the microalloyed steel.

The preferred microalloyed steel consists essentially of the following by weight: from about 0.06 to about 0.12 percent carbon, from about 1.0 to about 1.4 percent manganese, from about 0.05 to about 0.15 percent vanadium, from about 0.1 to about 0.5 percent silicon, from about 0.005 to about 0.02 percent nitrogen, up to about 0.02 percent sulfur, up to about 0.02 percent phosphorus, and the balance substantially all iron.

The method of the invention is generally as follows. The microalloyed steel is first heated to a relatively high temperature and for a duration sufficient for the vanadium nitride precipitates to dissolve. (That temperature at which the precipitates of vanadium nitride dissolve to vanadium and nitrogen is known as the vanadium nitride precipitate solvus and varies depending on the composition of the steel.) The preferred temperature ranges from about 1100° C. to about 1200° C. with the duration at this temperature being a few minutes up to about thirty minutes. The exposure at this temperature must be sufficient to put the vanadium and nitrogen into solid solution within the material.

The microalloyed steel is then cooled from this first temperature at an extraordinarily slow rate. The cooling rate is chosen to be sufficiently slow so as to produce a very large ferrite grain size in the microalloyed steel. This slow cooling rate is also chosen so as to cause the vanadium nitride to precipitate as coarse particles which produce minimal strengthening of the ferrite matrix.

Generally, in a high strength microalloyed steel of this composition, the strength is provided by fine precipitates homogeneously dispersed within the ferrite matrix, and wherein the ferrite matrix is also characterized by fine ferrite grains. This is accomplished by thermomechanical working and rapid cooling below the vanadium nitride solvus, so that the vanadium nitride would precipitate out of solution to form uniformly distributed fine particles of vanadium nitride within the ferrite, and so as to concurrently limit the amount of grain growth by the ferrite.

However, the slow cooling rate of the preferred method of this invention is chosen so as to allow the vanadium nitride to precipitate over a longer time period. This causes the resulting material to have coarse, overaged particles of vanadium nitride randomly dispersed throughout the ferrite matrix. In addition, because of the slow cooling rate, the ferrite grains are enabled to grow to relatively large proportions. Thus the resulting microalloyed steel is typified by coarse, overaged vanadium nitride particles dispersed throughout large grains of ferrite. This type of metallurgical structure is characterized by low strength, but high ductility, which results in good formability (including machinability) at room temperature. Therefore, in general, the cooling rate is chosen so as to minimize the strengthening contributions associated with the precipitation strengthening mechanisms and the ferrite grain size.

After room temperature forming of the component from this low strength microalloyed steel, the material is then exposed to a second temperature and duration which is sufficient to again solutionize the vanadium and nitrogen within the ferrite matrix of the steel. This temperature must exceed the vanadium nitride precipitate solvus and when in the range from about 1100° C. to about 1200° C. requires a duration at this temperature of again just about a few minutes up to about ten or more minutes. When the method of this invention is used in the intended application for a torque converter pump housing, this second heating step occurs concurrently with the high temperature copper brazing process.

However, the cooling rate from this second heating step is significantly faster than the first cooling rate. The second cooling rate prohibits excessive grain growth in the ferrite matrix while also causing precipitation of well dispersed, fine vanadium nitride precipitates throughout the microalloyed steel. With this type of metallurgical structure, the microalloyed steel component is characterized by high strength yet sufficient ductility, and is suitable for a variety of demanding application such as an automotive torque converter pump housing.

A particularly advantageous feature of the thermal treatment method of this invention for a microalloyed steel is that the thermal treatment causes the microalloyed steel to be initially characterized by good ductility and low strength for forming of the material prior to copper brazing, yet after copper brazing the material is characterized by exceptionally high strength. Components formed from the preferred microalloyed steel and treated in accordance with the method of this invention exhibited formability nearly equal to that of the previous low strength AISI 1010 steels, but significantly higher strengths after copper brazing as compared to the conventional materials.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

This invention provides a method for thermally treating a high strength, microalloyed steel so as to lower its yield strength and correspondingly increase its ductility. This enables the manufacturing of components from such a microalloyed steel on tooling designed for low carbon, (low strength) steels such as AISI 1010. The components formed from such a microalloyed steel then develop much higher strength (than can be attained with the conventional materials) after an additional high temperature operation, which for the intended application of a torque converter pump housing, is concurrent with a copper brazing process.

Although the intended application for the thermal treatment method of this invention is a copper brazed torque converter pump housing formed from the preferred high strength microalloyed steel within an automotive automatic transmission system, it is foreseeable that the teachings of this invention could be extended to other situations where a high strength material is desired in the final component, but wherein sufficient ductility is required for forming of the component prior to its intended application. In particular, these teachings could be extended to the production of other copper brazed components formed from microalloyed steel. Therefore, the exemplary description of a torque converter pump housing is for illustrative purposes only.

Figure 1:
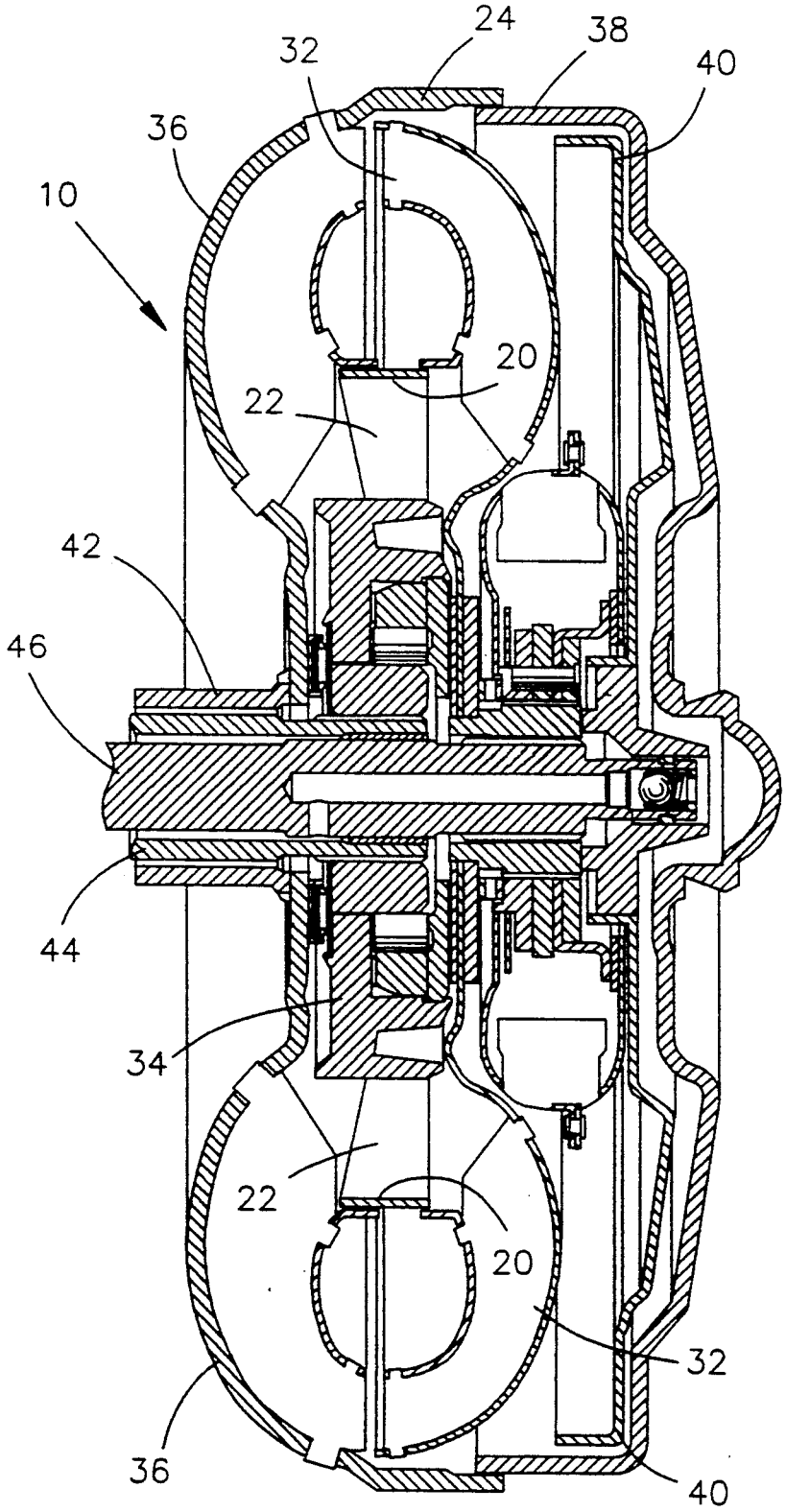
FIG. 1 is a cross-sectional view of a conventional torque converter.

Shown cross-sectionally in FIG. 1 is a conventional torque converter 10 commonly used in automotive applications. The function of the torque converter 10 is to transfer the torque generated by an automobile engine (not shown) to the automobile's drive axle (not shown) through a fluid medium, such as an oil. The flow of the oil is illustrated by the arrows shown in the exploded view of FIG. 2. The fluid medium allows speed variations, or slippage, between the engine and the drive axle which are necessary during gear selection, along with other benefits such as vibration damping and attenuation of peak torques.

Figure 2:
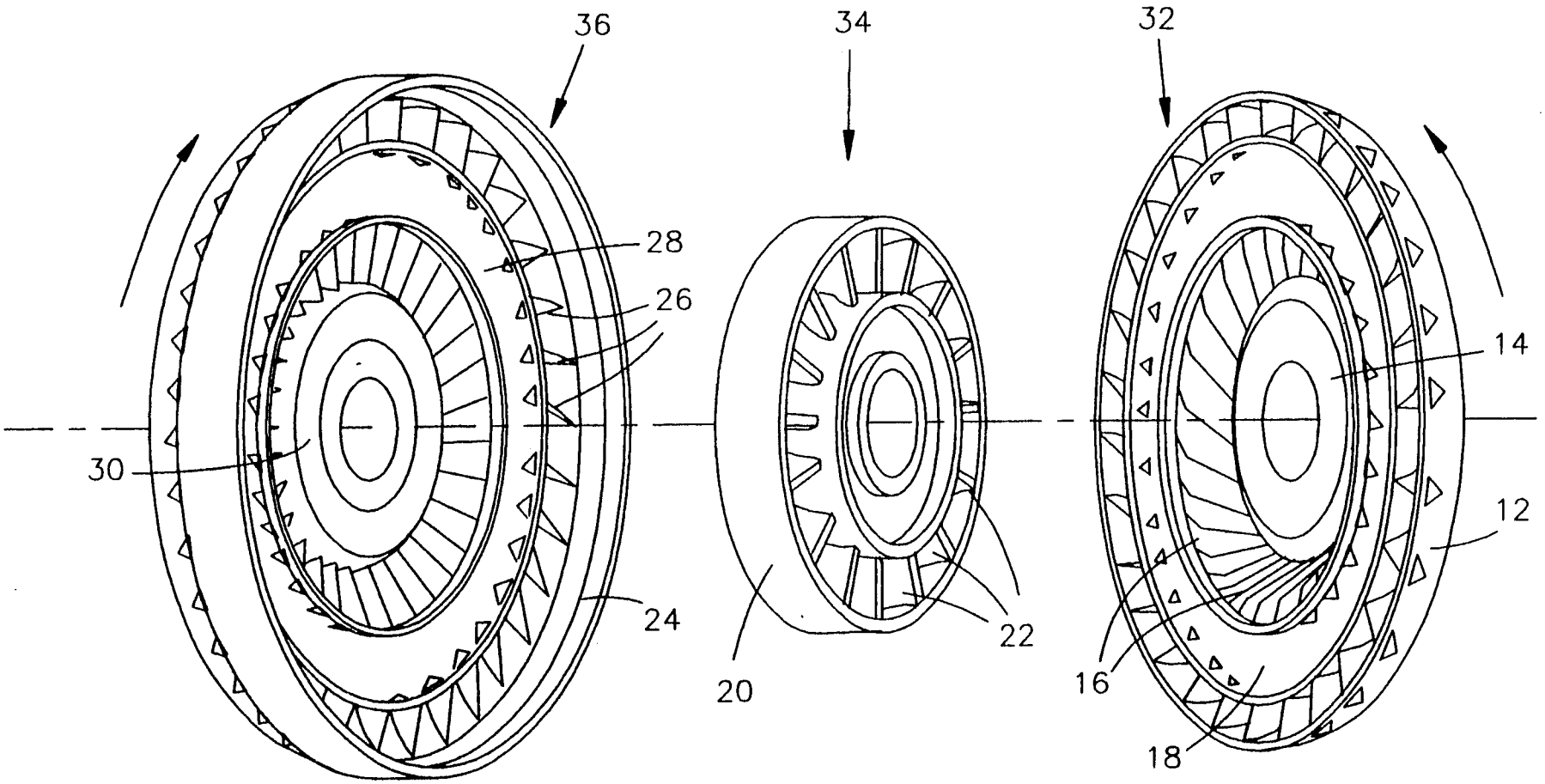
FIG. 2 is a schematic view showing the fluid flow within a torque converter.

As best seen in FIG. 2, the torque converter 10 primarily includes a turbine assembly 32, a stator assembly 34, and a torque converter pump assembly 36, which are all mounted coaxially so as to allow relative rotation therebetween. The torque converter pump assembly 36 has a pump housing 24 with a central hub 30. Extending radially from the central hub 30 are a number of pump blades 26. Secured to the pump blades 26 is an annular ring 28 which circumscribes the central hub 30, and which in turn is circumscribed by the perimeter of the pump housing 24.

Similarly, the turbine assembly 32 has a turbine housing 12 with a central hub 14. Extending radially from the central hub 14 are a number of turbine blades 16 which are attached to an annular ring 18. The turbine assembly 32 is enclosed within the torque converter pump assembly 36 by a converter housing cover assembly having a pressure plate assembly 40 disposed between the turbine assembly 32 and a converter housing cover 38. Located between the converter pump assembly 36 and the turbine assembly 32 is the stator assembly 34. The stator assembly 34 has a number of stator vanes 22 which extend radially between a stator shaft 44 and an outer annular rim 20.

With reference again to FIG. 1, in operation the engine's mechanical output is transmitted to the torque converter pump assembly 36 through the converter pump housing 24 via the converter housing cover 38. The rotation of the converter pump assembly 36 through its central hub 30 causes the pump blades 26 to convert the mechanical output of the engine into flow energy within the fluid medium. The fluid medium passes through the stator assembly 34 on its way to the turbine assembly 32, where it is converted back into mechanical energy by the turbine blades 16. The resulting rotation of the turbine assembly 32 is then transmitted as rotational output through a turbine shaft 46 to the automobile's drive axle.

Figure 3:
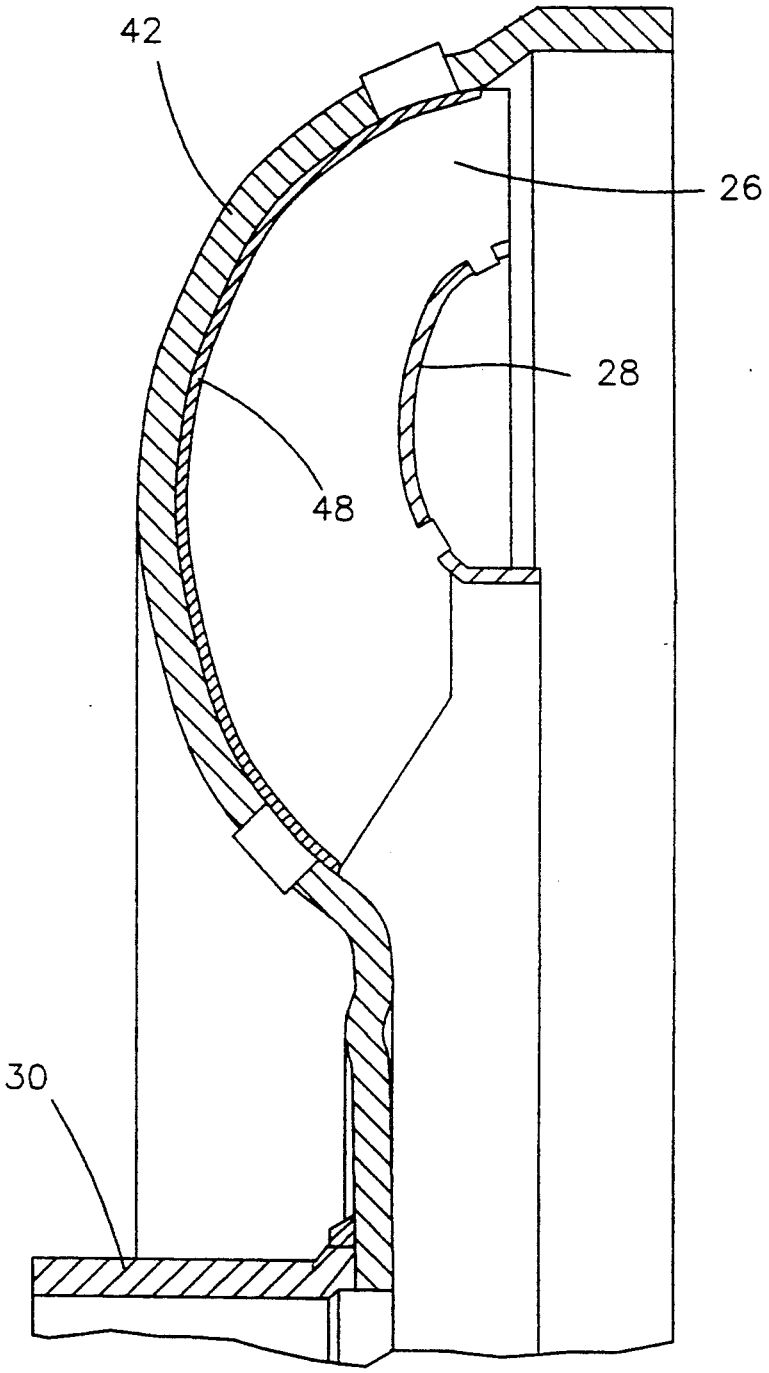
FIG. 3 is a cross-sectional view showing the copper brazed joints between the blades and the pump housing within the torque converter pump assembly of FIG. 1.

FIG. 3 is a cross-sectional view showing the copper brazed joint 48 (shown greatly exaggerated) between the insertion tangs of the pump blade 26 and the converter pump housing 24 within the torque converter pump assembly 36 of FIG. 1. In practice the copper brazed joint 48 typically extends the entire length between the blade 26 and pump housing 24, as shown, so as to ensure rigidity and a leak-free joint, however under some circumstances this may not be necessary. The copper brazed joint 48 attaches the pump blades 26 to both the radially outward and radially inward portions of the converter pump housing 24. As shown, the annular ring 28 is mechanically secured to the pump blades 26 by any conventional method known in the art, including by copper brazing techniques.

In particular, the preferred high strength microalloyed steel for use in the intended application of this method is characterized by the elemental composition shown in Table I., wherein the percentages refer to weight percents. Because of the low alloy content of this steel, it is referred to as a microalloyed steel, however it does belong to the broader class of steels known generally as high strength, low alloy (HSLA) steels. In addition, it is to be noted that other steels and alloys could be used successfully with this method such as many of the high strength low alloy steels.

TABLE I

| | |
|---|---|
| C | 0.06%-0.12% |
| Mn | 1.0%-1.4% |

TABLE I-continued

| | |
|---|---|
| V | 0.05%-0.15% |
| Si | 0.1%-0.5% |
| N | 0.005%-0.02% |
| S | 0.02% (max) |
| P | 0.02% (max) |
| Fe | Balance |

The mechanical properties of this steel are determined by its microstructure. Generally, its strength is increased by increasing the fineness of the ferrite grains making up the matrix, and increasing the amount of dispersed phases or dislocations within the ferrite. Conversely, its strength is generally decreased by decreasing the contribution of those factors.

The carbon (C) content of this high strength microalloyed steel is sufficiently low, as well as the total amount of the other alloying elements, so that the matrix of the steel will be primarily ferrite, which is body-centered cubic iron (Fe). The small amount of carbon may tend to react with the iron to form iron carbide, $Fe_3C$, as well as react with the vanadium (V) and the other constituents to form carbides or carbo-nitrides which would reside in the grain boundaries as well as within the ferrite grains. Carbon in excessive amount is undesirable as it may cause the steel to become brittle. The preferred range of carbon of from about 0.06 to 0.12 weight percent, with a nominal composition of about 0.10 weight percent being most preferred, provides the necessary strengthening mechanisms without unnecessary brittleness.

The manganese (Mn) addition of from about 1.0 to about 1.4 percent, with a nominal concentration of about 1.3 percent being most preferred, provides strength to the steel through solid solution, strengthening. It should be noted also that it has been observed that a manganese content of this preferred range tends to enhance the precipitation hardening affect associated with the vanadium by lowering the austenite-to-ferrite transition temperature.

The vanadium (V) content within the microalloyed steel ranges from about 0.05 to about 0.15 percent, with a nominal concentration of about 0.1 percent being most preferred. During exposure to elevated temperatures, the vanadium reacts with the available nitrogen and carbon to form vanadium nitride and/or vanadium carbide and/or vanadium carbonitride precipitates. The precipitation of vanadium nitride and/or carbide particles at the moving austenite-ferrite boundary and within the ferrite provides a marked increase in strength generally. The presence of vanadium also affects the refinement of the ferrite grains. These factors are critical to the thermal treatment method of this invention, and will be discussed more fully later.

The silicon (Si) concentration ranges from about 0.1 to about 0.5 percent, with a nominal concentration of about 0.4 percent being desired Silicon contributes to solid solution strengthening. In addition, it is foreseeable that other applications may not require silicon.

The nitrogen (N) content ranges from about 0.005 to about 0.02 percent, with a nominal concentration of about 0.015 percent being most preferred. The nitrogen is necessary so as to enable the precipitation hardening mechanism of the vanadium nitride particles. This amount of nitrogen also enhances the strengthening effect of vanadium carbides through substitution with carbon to form vanadium carbonitrides.

Sulfur (S) and phosphorus (P), each preferably ranging below about 0.02 weight percent, are typically always present within steels. The steel used with the method of this invention had a nominal concentration of each of these alloys of about 0.015 percent. The phosphorus may enhance the strength properties of the steel by entering into solid solution within the ferrite.

The balance of the microalloyed steel employed with the thermal treatment method of this invention is substantially iron (Fe).

In addition, aluminum (Al) in the amounts of about 0.02 to about 0.06 weight percent may be present depending on the deoxidation practice used during steelmaking.

It is to be noted that either niobium or titanium could be substituted for all or part of the vanadium concentration within the steel, with satisfactory results expected. Niobium and titanium would also form the desired nitride and/or carbide precipitates within the ferrite matrix for precipitation hardening of the microalloyed steel. However, vanadium has a higher sensitivity to thermal treatment than the niobium or titanium and is therefore preferred. This higher thermal sensitivity is due to vanadium's greater solubility in the steel and the vanadium carbonitrides' more rapid coarsening kinetics, as compared to the carbonitrides of niobium or titanium. Thus the use of vanadium results in larger ferrite grains and coarser vanadium precipitates within the microalloyed steel, for the same rate of cooling, as compared to the niobium and/or titanium, and is therefore more effective at lowering the strength of this steel for enhanced formability.

The particular thermal treatment steps of the method of this invention are as follows. First, hot rolled sheet of the vanadium-microalloyed steel, having the preferred composition described above, was ground to a thickness of about 5.33 millimeters (or 0.210 inches). Tensile bars of approximately 50 millimeter gage length were lasercut from this sheet and then thermally processed.

It is believed that the effect of this method is not dependent on the size or structure of the steel component. Therefore, it is expected that the same effect would be realized over a tremendous variation in size and shapes of the formed steels.

The vanadium-microalloyed steel bars were first heated to a sufficiently elevated temperature for the vanadium and nitrogen to go into solution. Specifically, this was accomplished by annealing the bars in a protective atmosphere, such as a vacuum, through a programmed thermal cycle incorporating these steps: heating to about 1120° C. over a period of about thirty minutes, soaking at that temperature for about twenty minutes, and then cooling at a rate of about 5° C. per minute to below about 500° C., whereat the parts were cooled in air. (The kinetics of precipitation of vanadium nitride is so slow below about 500° C., that the cooling rate below this temperature makes little practical difference to the resulting metallurgical structure.) The preferred temperature may range from about 1100° C. to about 1200° C. with the duration at this temperature being only a few minutes up to about thirty minutes. The temperature must be sufficient to put into solid solution all of the elements, including the vanadium and nitride of the vanadium nitride, which is the vanadium nitride precipitation solvus temperature. In practice this temperature is generally between about 1050° C. and 1100° C., and will vary depending on the composition of the steel employed. This is generally achieved after only a few minutes of exposure at the elevated temperature. A temperature higher than about 1200° C. is not desired or practical since it is costly and unnecessary for solutionizing the elements within the steel, and further can cause steel to sag under its own weight.

The cooling rate during this annealing step is critical to the outcome of this invention. The vanadium-microalloyed steel must be cooled from the elevated temperature at this extremely slow rate. Although a cooling rate of about 5° C. per minute is preferred, it is believed that the cooling rate could range from about 3° C. per minute all the way to as slow a cooling rate as within the practical limits of the equipment.

The cooling rate is chosen to be sufficiently slow so as to minimize the strengthening contributions associated with the ferrite grain size and the precipitation strengthening mechanisms within the steel. This extremely slow cooling rate causes excessive grain growth of the ferrite which is the principal constituent of the microalloyed steel. The large ferrite grains diminish the strength of the resulting material, resulting in higher ductility. In addition, this slow cooling rate also causes the vanadium nitride particles to precipitate over an extended time period, thereby becoming coarse and overaged within the ferrite matrix. This type of low strength metallurgical structure is characterized by high ductility which results in good formability (including machinability) at room temperature.

The mechanical properties for the vanadium-microalloyed steel, in an as-received hot-rolled sheet stock condition, and in an as-annealed condition in accordance with the method of this invention are listed in Table II. The measurements were made using standard testing techniques.

TABLE II

| | As-Received | As-Annealed (1120° C.) |
|---|---|---|
| Yield Strength | 88 ksi | 42 ksi |
| Ultimate Tensile Strength | 103 ksi | 66 ksi |
| Total Elongation | 24% | 34% |
| Rockwell B Hardness | 102 | 78 |

The as-annealed mechanical properties exhibited lower strength and higher ductility as compared to the as-received vanadium-microalloyed steel. The high temperature anneal and controlled slow cooling rate decreased the yield strength from about 88 ksi to about 42 ksi while simultaneously increasing the tensile elongation from about 24% to about 34%, which is indicative of increased ductility. The hardness was reduced from about 102 HRB to about 78 HRB. This combination of lower strength and higher ductility in the annealed material results in increased formability of the steel. In particular the vanadium-microalloyed steel of this invention was formed into components at room temperature using the same tooling designed for AISI 1010 steel, with nearly equivalent results obtained. The strength and hardness of the annealed microalloyed steel remained somewhat higher than the corresponding properties of the AISI 1010 steel.

Some of the annealed test bars of the vanadium-microalloyed steel were then processed through the copper brazing cycle used in the production of the torque converter pump assemblies. During copper brazing, the bars are exposed to a second temperature, which is sufficient to again solutionize the vanadium and nitrogen within the ferrite matrix of the steel. This temperature, the vanadium nitride precipitate solvus, is approximately 1050° C., but is dependent on specific alloy composition, therefore a temperature of from about 1100° C. to about 1200° C. is sufficient with the duration at this temperature being from only a few minutes to about ten or more minutes. Again, solutionizing of the elements at this temperature occurs fairly rapidly. More specifically, the copper brazing cycle includes heating the bars in a protective atmosphere to a temperature of about 1120° C. over a period of about twenty minutes, soaking at that temperature for about five minutes, and then cooling at a rate of about 30° C. per minute to below about 500° C., after which the parts are cooled at a slower rate to room temperature. The brazing temperature is sufficient to put into solid solution all of the elements, including the vanadium and nitrogen of the vanadium nitride.

It is to be noted that the copper brazing cycle is merely a convenience for the intended application of a copper brazed torque converter pump assembly 36, since the copper brazing process exposes the components to the desired temperature profile while also achieving the desired braze joint 48. If the intended application did not include copper brazing of the pump blades 26 to the pump housing 24 (shown by the braze joint 48 in FIG. 3), but rather required a low strength, high ductility component for forming and then a finished component having high strength in some other application, the second heating step would be performed without a copper brazing step.

The cooling rate from this second heating step is significantly faster than the slow cooling rate employed after the first heating step. This second cooling rate prohibits excessive grain growth by the ferrite matrix while also forcing precipitation of fine vanadium nitride particles throughout the ferrite matrix. With this metallurgical structure, the vanadium-microalloyed steel component is characterized by high strength and is suitable for a variety of demanding applications such as an automotive torque converter pump housing 24.

The mechanical properties for the vanadium-microalloyed steel, in an as-annealed and brazed condition are listed in Table III. The measurements were made using standard testing techniques.

TABLE III

| | As-Annealed + Brazed (1120° C.) |
|---|---|
| Yield Strength | 55 ksi |
| Ultimate Tensile Strength | 72 ksi |
| Total Elongation | 30% |
| Rockwell B Hardness | 84 |

The strength of the vanadium-microalloyed steel components which were annealed and brazed was significantly higher than the corresponding measurements for the as-annealed material, as well as more than about twice the corresponding values for AISI 1010 steel, which is the steel currently used for the torque converter pump housings 24. Therefore with the method of this invention, the vanadium-microalloyed steel can be formed easily at room temperature using the tooling designed for low strength AISI 1010 steel, yet the finished component provides about twice the strength for high performance applications as compared to the AISI 1010.

The difference in strength between the as-received, annealed, and brazed conditions of the vanadium-microalloyed steel are explained on the basis of grain size and the influence of thermal processing on precipitation strengthening mechanisms within the steel. Firstly, the mean ferrite grain sizes for the various conditions were as follows: about 4.0 microns for the as-received steel, about 16.3 microns for the as-annealed (at 1120° C.) steel, and about 8.8 for the as-brazed steel. By first annealing the as-received steel, the strength is decreased by increasing the ferrite grain size and by decreasing the precipitation strengthening mechanisms. The extraordinarily slow cooling rate of about 5° C. per minute is largely responsible for both of these effects. However, during the subsequent thermal treatment step, or brazing cycle, the grain size decreased and precipitation strengtheners increased so as to result in higher strength for the as-brazed steel. It is foreseeable that the cooling rate following brazing could be optimized to increase the precipitation strengthening mechanisms and further improve post-braze strength of the steel.

In particular, actual torque converter pump housings 24 were formed and thermally treated in accordance with the method of this invention. Blanks prepared from the as-received microalloyed steel (chemical composition shown in Table I.) were first annealed for about twenty minutes at about 1200° C. The as-received blanks had an average yield strength of about 88 ksi. These blanks were cooled at a rate of about 5° C. per minute so as to lower the strength and increase the ductility of the steel. The strength of the as-annealed material was not determined, however it is presumed that it would be on the order of about 40 ksi, which is the yield strength for the sample tensile test bars which were annealed at only 1120° C. shown in Table II. High ductility was observed though, since the formability of the annealed blanks was sufficiently comparable to the AISI 1010 steel. Blanks from the microalloyed steel were stamped into pump housings 24 on current-production tooling designed for AISI 1010 steel. In addition, no extraordinary distortion was observed on the as-stamped housings 24 even after the high temperature thermal treatment to lower the strength of the steel.

The housings 24 were then conventionally copper brazed by heating to about 1120° C. for about ten minutes and then cooling to about 500° C. over a period of about twenty minutes. The resulting high strength of the copper-brazed housing 24 following this second thermal treatment step was demonstrated in the performance of the brazed pump assemblies, which showed excellent resistance to plastic deformation during high RPM operation. Copper brazed AISI 1010 exceed the 0.1 millimeter permanent set design limit in the range of 5000 to 6000 RPM with catastrophic failure occurring shortly thereafter. In contrast, the vanadium-microalloyed pumps performed well within the design limit to about 7500 RPM, and the one component taken even higher exhibited only 0.11 millimeters of permanent deformation following a 9000 RPM exposure.

Therefore, the high strength vanadium-microalloyed steel was thermally treated in accordance with this invention so as to be initially characterized by low strength and high ductility for forming of a component from the steel, and then thermally treated to have exceptionally high strength. It is foreseeable that other materials could be employed instead of the high strength vanadium-microalloyed steel disclosed, as well as other methods for exposing the high strength steel to the first thermal treatment step so as to enlarge the ferrite grain size and minimize the precipitation strengthening effect. In particular, the steelmaking practices could be modified so as to heat the entire coil of high strength steel to the desired solutionizing temperature, or alternatively an isothermal anneal could be utilized to overage the precipitates however this would have little effect on the ferrite grain size.

Therefore, while our invention has been described in terms of a preferred embodiment, it is apparent that other forms could be adopted by one skilled in the art, such as by modifying the microalloyed steel within the preferred ranges of element concentrations as well as substituting titanium or niobium for the vanadium content, or by modifying the processing steps employed, or by modifying the final intended use for the steel. Accordingly, the scope of our invention is to be limited only by the following claims.

The embodiments of the invention in which an exclusive property or privilege is claimed are defined as follows:

1. A method for thermally treating a high strength steel to initially induce low strength with sufficient ductility for enhanced formabilty of said high strength steel at room temperature, prior to a subsequent thermal treatment adapted to induce high strength within a formed component of said high strength steel, comprising the steps of:

providing a high strength, microalloyed steel comprising the following by weight: from about 0.06 to about 0.12 percent carbon, from about 1.0 to about 1.4 percent manganese, from about 0.05 to about 0.15 percent vanadium, from about 0.1 to about 0.5 percent silicon, from about 0.005 to about 0.02 percent nitrogen, and the balance being substantially all iron;

said high strength, microalloyed steel being heated to a first temperature and for a first duration sufficient to solutionize said vanadium and nitrogen from vanadium nitride particles within the ferrite of the microalloyed steel;

cooling said microalloyed steel from said first temperature at a sufficiently slow first rate so as to produce large grains of ferrite and coarse precipitates of said vanadium nitride particles within said ferrite, thereby after said cooling step said microalloyed steel being characterized by a strength which is significantly lower than its high strength prior to said first heating step, as well as sufficient ductility so as to be readily formed at room temperature;

heating said microalloyed steel to a second temperature and for a second duration sufficient to solutionize said vanadium and nitrogen within said ferrite of said microalloyed steel; and then cooling at a second rate from said second temperature, said second rate of cooling being substantially faster than said first rate of cooling, said second rate of cooling being sufficient to produce fine ferrite grains and uniformly dispersed fine vanadium nitride precipitates within said ferrite of said microalloyed steel, such that said microalloyed steel is now characterized by relatively high strength as compared to said strength after said first heating step.

2. A method for thermally treating a high strength steel as recited in claim 1 wherein said first temperature ranges from about 1050° C. to about 1200° C.

3. A method for thermally treating a high strength steel as recited in claim 1 wherein said first cooling rate from said first temperature is about 3° C. per minute or slower.

4. A method for thermally treating a high strength steel as recited in claim 1 wherein said second temperature ranges from about 1050° C. to about 1200° C.

5. A method for thermally treating a high strength steel as recited in claim 1 wherein said second cooling rate from said second temperature is at least 20° C. per minute.

6. A method for thermally treating a high strength steel as recited in claim 1 wherein said second heating step occurs concurrently with a copper brazing cycle.

7. A method for forming a torque converter pump housing suitable for use in an automotive automatic transmission system, comprising the following steps:

heating a high strength, microalloyed steel to a first temperature ranging from about 1050° C. to about 1200° C.; said high strength, microalloyed steel comprising the following by weight: from about 0.06 to about 0.12 percent carbon, from about 1.0 to about 1.4 percent manganese, from about 0.05 to about 0.15 percent vanadium, from about 0.1 to about 0.5 percent silicon, from about 0.005 to about 0.02 percent nitrogen, and the balance being substantially all iron; said heating at said temperature being for a duration sufficient to solutionize vanadium and nitrogen from vanadium nitride particles within the ferrite of the microalloyed steel;

cooling said microalloyed steel from said first temperature at a sufficiently slow first rate so as to produce large grains of ferrite and coarse precipitates of said vanadium nitride particles within said ferrite, thereby after cooling, said microalloyed steel being characterized by a strength which is significantly lower than its high strength prior to said first heating step, as well as sufficient ductility so as to be readily formed at room temperature;

forming a torque converter pump housing from said microalloyed steel after said first heating and cooling steps;

heating said torque converter pump housing to a second temperature ranging from about 1050° C. to about 1200° C. and for a second duration sufficient to solutionize said vanadium and nitrogen within said ferrite of said torque converter pump housing; and then cooling at a second rate from said second temperature, said second rate of cooling being substantially faster than said first rate of cooling, said second rate of cooling being sufficient to produce fine ferrite grains and uniformly dispersed fine vanadium nitride precipitates within said ferrite of said torque converter pump housing, such that said torque converter pump housing is characterized by relatively high strength as compared to said strength after said first heating step.

8. A method for forming a torque converter pump housing as recited in claim 7 wherein said first cooling rate from said first temperature is about 3° C. per minute or slower.

9. A method for forming a torque converter pump housing as recited in claim 7 wherein said second cooling rate from said second temperature is at least 20° C. per minute.

10. A method for forming a torque converter pump housing as recited in claim 7 wherein said second heating step occurs concurrently with a copper brazing cycle.

* * * * *